US007585038B2

(12) United States Patent
Shibata et al.

(10) Patent No.: US 7,585,038 B2
(45) Date of Patent: Sep. 8, 2009

(54) INKJET PRINTING METHOD AND INKJET PRINTING APPARATUS

(75) Inventors: Tsuyoshi Shibata, Kanagawa (JP); Kazuyuki Maeda, Kanagawa (JP); Hitoshi Tsuboi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/623,541

(22) Filed: Jul. 22, 2003

(65) Prior Publication Data

US 2004/0119766 A1 Jun. 24, 2004

(30) Foreign Application Priority Data

Jul. 24, 2002 (JP) ..... 2002-215847

(51) Int. Cl.
*B41J 29/38* (2006.01)

(52) U.S. Cl. ..... 347/12

(58) Field of Classification Search ..... 347/19, 347/12; 400/74

See application file for complete search history.

(56) References Cited

U.S. PATENT DOCUMENTS

| | | | | |
|---|---|---|---|---|
| 4,313,124 | A | 1/1982 | Hara | |
| 4,345,262 | A | 8/1982 | Shirato et al. | |
| 4,459,600 | A | 7/1984 | Sato et al. | |
| 4,463,359 | A | 7/1984 | Ayata et al. | |
| 4,558,333 | A | 12/1985 | Sugitani et al. | |
| 4,723,129 | A | 2/1988 | Endo et al. | |
| 4,740,796 | A | 4/1988 | Endo et al. | |
| 5,929,875 | A * | 7/1999 | Su et al. | 347/19 |
| 6,278,469 | B1 * | 8/2001 | Bland et al. | 347/19 |
| 6,343,846 | B1 | 2/2002 | Asano | |
| 6,428,139 | B1 * | 8/2002 | Silverbrook | 347/19 |
| 6,439,681 | B1 * | 8/2002 | McClellan | 347/14 |
| 6,481,816 | B1 * | 11/2002 | Oyen | 347/12 |
| 6,575,549 | B1 * | 6/2003 | Silverbrook | 347/19 |
| 2003/0086100 | A1 | 5/2003 | Yashima et al. | |
| 2003/0103098 | A1 | 6/2003 | Yashima et al. | |
| 2004/0223014 | A1 * | 11/2004 | Barr et al. | 347/12 |

FOREIGN PATENT DOCUMENTS

| | | |
|---|---|---|
| EP | 0 568 181 | 11/1993 |
| EP | 0 914 954 | 5/1999 |
| EP | 1 010 531 | 6/2000 |
| EP | 1 060 896 | 12/2000 |
| EP | 1 314 561 | 5/2003 |
| JP | 59-123670 | 7/1984 |
| JP | 59-138461 | 8/1984 |
| JP | 1-188861 | 7/1989 |
| JP | 2000-177111 | 6/2000 |
| JP | 2001-10028 | 1/2001 |
| JP | 2001-219551 | 8/2001 |
| JP | 2001-240270 | 9/2001 |

* cited by examiner

*Primary Examiner*—Julian D Huffman
(74) *Attorney, Agent, or Firm*—Fitzpatrick, Cella, Harper & Scinto

(57) ABSTRACT

The present invention makes it possible to print a good quality image even if ink is ejected abnormally from a nozzle. To attain this, when there is an abnormal nozzle (N) exhibiting an abnormal ink ejection state, the printing data corresponding to the abnormal nozzle (N) is added to the printing data corresponding to neighboring nozzles (N−1) and (N+1) arranged in the neighborhood of the abnormal nozzle (N). In this way, the printing data corresponding to the abnormal nozzle (N) can be compensated.

2 Claims, 13 Drawing Sheets

PRINTING DATA OF A NORMAL NOZZLE

PRINTING DATA OF EJECTION-DEFECTIVE MALFUNCTIONING NOZZLE (ABNORMAL NOZZLE)

PRINTING DATA COMPENSATED BY NEIGHBORING NOZZLE

PRINTING DATA OF A NORMAL NOZZLE

PRINTING DATA OF EJECTION-DEFECTIVE MALFUNCTIONING NOZZLE (ABNORMAL NOZZLE)

PRINTING DATA COMPENSATED BY NEIGHBORING NOZZLE

PRINTING DATA OF A NORMAL NOZZLE

PRINTING DATA OF EJECTION-DEFECTIVE MALFUNCTIONING NOZZLE (ABNORMAL NOZZLE)

PRINTING DATA COMPENSATED BY NEIGHBORING NOZZLE

PRINTING DATA OF A NORMAL NOZZLE

PRINTING DATA OF EJECTION-DEFECTIVE MALFUNCTIONING NOZZLE (ABNORMAL NOZZLE)

PRINTING DATA COMPENSATED BY NEIGHBORING NOZZLE

INKJET PRINTING METHOD AND INKJET PRINTING APPARATUS

This application claims priority from Japanese Patent Application No. 2002-215847 filed Jul. 24, 2002, which is incorporated hereinto by reference.

BACKGROUND OF THE INVENTION

1. Field of the Invention

The present invention relates to an inkjet printing method and inkjet printing apparatus for printing an image by use of a printing head capable of ejecting ink.

The present invention is applicable to all appliances using a printing medium, such as paper, cloth, leather, non-woven cloth, OHP sheet, and metal. Specific examples of the appliances include office equipment, such as printers, copiers, and facsimiles, and industrial manufacturing machines.

2. Description of the Related Art

With wide dispersion of copying machines, information processing equipment, such as word-processors and computers, and communication equipment, an inkjet printing apparatus that prints digital images by an inkjet system has rapidly become popular and is often used as an output device in these machines for forming (printing) an image. In these inkjet printing apparatuses, to improve a printing speed, a printing head, in which a plurality of ink ejection nozzles, ink ejection ports, and ink flow channels are densely arranged, is used. Furthermore, with an increase in the requirement for color image formation, a printing apparatus having a plurality of such printing heads has often been seen.

In the inkjet printing system, ink droplets serving as a printing liquid are ejected out of a printing head and landed on a printing medium, such as a paper sheet, to form ink dots to perform printing on the printing medium. Since this printing system is a non-contact printing system in which a printing head is not in contact with a printing medium, noise can be reduced. Furthermore, if nozzles for ejecting ink are densely arranged, a printed image can be formed with a high resolution at a high speed. In addition, a high-quality image can be printed on a printing medium, such as plain paper, at a low cost without requiring any particular treatment, such as development and fixation. In particular, since an on-demand inkjet printing apparatus easily attains color-image formation, and may be miniaturized and simplified, prospective demand is expected in the future. Furthermore, with the tendency toward color image printing, demand to print an image with a high quality at a high speed is increasing.

However, the aforementioned conventional method has various problems as described below.

When a printing head having a plurality of inkjet nozzles integrally and densely arranged therein is used, if one or a plurality of ink ejection nozzles are clogged or fail in function by unknown reasons, ink dots are not formed by the defective nozzle(s) on a printing medium. Such ejection-failure may produce a white streaking on the printed image, deteriorating image quality significantly. On the other hand, a similar problem may occur when ink ejection abnormality takes place from one or a plurality of ejection nozzles, in other words, when ejection-failure of ink takes place for unknown reasons. To be more specific, a printed image with a white streaking or a streaking uneven in density is formed, significantly deteriorating image quality.

The preferred method of improving the quality of a printed image involves an ink ejection state being recovered by a cleaning mechanism when a nozzle causes ejection failure or mal-ejection. Alternatively, use may be made of a multi-pass system in which an image is completely printed by passing (scanning) a printing head a plurality of times. In this method, a nozzle ejecting no ink and a nozzle malfunctioning in ejection (hereinafter referred to as an "ejection-defective, malfunctioning nozzle" or "abnormal nozzle") are replaced by nozzles complementarily arranged. However, the former method including a recovery operation requires a cleaning time and consumes much ink, increasing cost. In addition, this method is not favorable from an ecological point of view toward reducing ink consumption. In the latter multi-pass method, the printing time is long.

Accordingly, there is a need to develop an inkjet printing apparatus to overcome the aforementioned conventional problems and print an image with a higher quality at a higher speed and lower cost.

SUMMARY OF THE INVENTION

An object of the present invention is to provide an inkjet printing method and device capable of printing a high quality image when ink droplets are abnormally ejected out of a nozzle.

In a first aspect of the present invention, there is provided an inkjet printing method using a printing head having a plurality of nozzles capable of ejecting ink for printing an image by ejecting ink out of the nozzles based on printing data which instructs ejection or non-ejection of ink.

The printing data corresponding to an abnormal nozzle malfunctioning in ink-ejection is added to the printing data corresponding to a neighboring nozzle of the abnormal nozzle.

In a second aspect of the present invention, there is provided an inkjet printing apparatus for printing an image by use of a printing head having a plurality of nozzles capable of ejecting ink and by ejecting ink out of the nozzles based on printing data which instructs ejection or non-ejection of ink, comprising compensation means for adding the printing data corresponding to an abnormal nozzle malfunctioning in ink-ejection to the printing data corresponding to a neighboring nozzle arranged in the neighborhood of the abnormal nozzle.

According to the present invention, when there is an abnormal nozzle abnormally ejecting ink, the printing data corresponding to the abnormal nozzle is added to the printing data corresponding to a neighboring nozzle arranged in the neighborhood of the abnormal nozzle. Since the printing data corresponding to the abnormal nozzle is compensated, even if an abnormal nozzle is present, a high quality image can be printed. Therefore, a smooth gradation can be attained without increasing printing time or decreasing image quality due to a white streaking.

Furthermore, when there is an abnormal nozzle in a printing head, it is not necessary to immediately replace the abnormal nozzle by a new one and the printing head can be used for a long time. This feature is desirable from an ecological point of view.

Moreover, data processing speed can be increased by using, as printing data, driving data showing whether ink is ejected or not out of a nozzle rather than by using gradation data of an image upstream, since the amount of driving signal data is considered much lighter than that of the gradation data. For example, when printing data converted into binary data is used, the printing data corresponding to an abnormal nozzle may be added to a vacant space of the printing data corresponding to a neighboring nozzle.

Also, the present invention can be effectively applied not only to a single pass printing system but also to a multi-pass printing system since deterioration of an image due to a white streaking can be decreased by simple data processing.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The embodiments of the present invention will be now explained with reference to the accompanying drawings.

Figure 1:
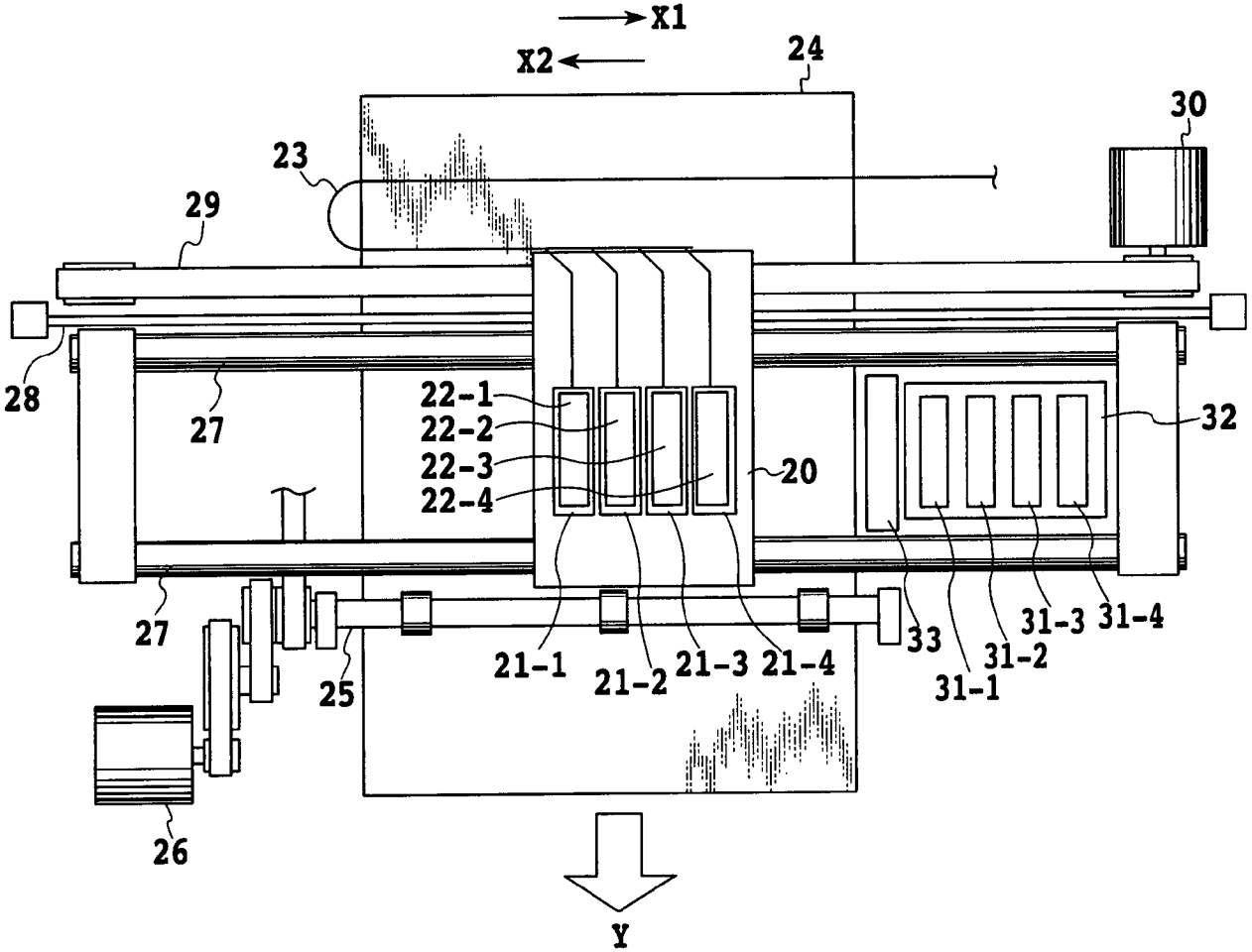
FIG. 1 is a schematic front view of an inkjet printing apparatus according to an embodiment of the present invention.

FIG. 1 is a schematic front view of an inkjet printing apparatus according to an embodiment of the present invention. On a carriage 20, a plurality of inkjet printing heads 21-1 to 21-4 are mounted. Each of the inkjet printing heads 21-1 to 21-4 has a plurality of ink ejection ports, each being a part of nozzles capable of ejecting ink. The heads 21-1, 21-2, 21-3, and 21-4 are inkjet printing heads for ejecting black (K), cyan (C), magenta (M), and yellow (Y) inks, respectively. The inkjet printing head 21 (21-1 to 21-4) and an ink tank for supplying ink to the printing head 21 construct an ink cartridge 22 (22-1 to 22-4).

A control signal is sent to the printing head 21 via a flexible cable 23. A printing medium 24, such as plain paper, high-quality exclusive use paper, OHP sheet, glossy paper, glossy film or post card, is transferred by a transfer roller (not shown), sandwiched by discharge rollers 25, and sent in the direction Y (sub scanning direction) indicated by an arrow. The carriage 20 is moved back and forth in a main scanning direction X1 and X2 (shown by arrows) along a guide shaft 27. The position of the carriage 20 is detected by a linear encoder 28. The carriage 20 is reciprocally moved in the main scanning direction by the driving force of a carriage motor 30 via a driving belt 29. Within the liquid-flow channel of the ink ejection port of the printing head 21, a heater element (electrothermal transducer) is provided for generating thermal energy for ejecting ink. When the heater element is driven based on a printing signal in accordance with timing of the detection signal read by the linear encoder 28, ink droplets are ejected out of the nozzle corresponding to the heater element. When the ink droplets are deposited on a printing medium, an image is formed.

At the home position of the carriage 20 set outside the printing region, a recovery unit 32 having a cap portion 31 (31-1 to 31-4) is arranged. When printing is not made, the carriage 20 is moved to the home position, the ink ejection port surface (the surface at which an ink ejection port is formed) of the printing head 21 (21-1 to 21-4) is closed by the corresponding cap portion 31 (31-1 to 31-4). In this manner, the ink ejection port is prevented from being clogged caused by ink fixation due to vaporization of an ink solvent or adhesion of a foreign matter such as dust.

The cap portion 31 is also used in a process for recovering ejection and injection in order to maintain a good ink ejection state of the printing head 21. More specifically, in the process for recovering ejection, ink is allowed to eject toward the cap portion 31 arranged at a distance from an ink ejection port in order to overcome the mal-ejection or clogging of the ink ejection port less frequently used. This process is also called "idle running". On the other hand, in the injection recovery operation, the pressure of a capped cap portion 31 is reduced by a pump, thereby injecting ink from an ink ejection port. In this manner, the ejection state of a malfunctioning ink ejection port is recovered. Reference numeral 33 indicates an ink-receiving portion. When each of printing heads 21-1 to 21-4 passes above the ink-receiving portion 33, it ejects ink toward the ink-receiving portion 33 immediately before initiation of printing operation. This operation is called "preparatory ejection". Furthermore, if a blade and a wiping member (not shown) are arranged in the proximity of the cap portion 31, the ink ejection port surface of the printing head 21 can be cleaned.

Figure 2:
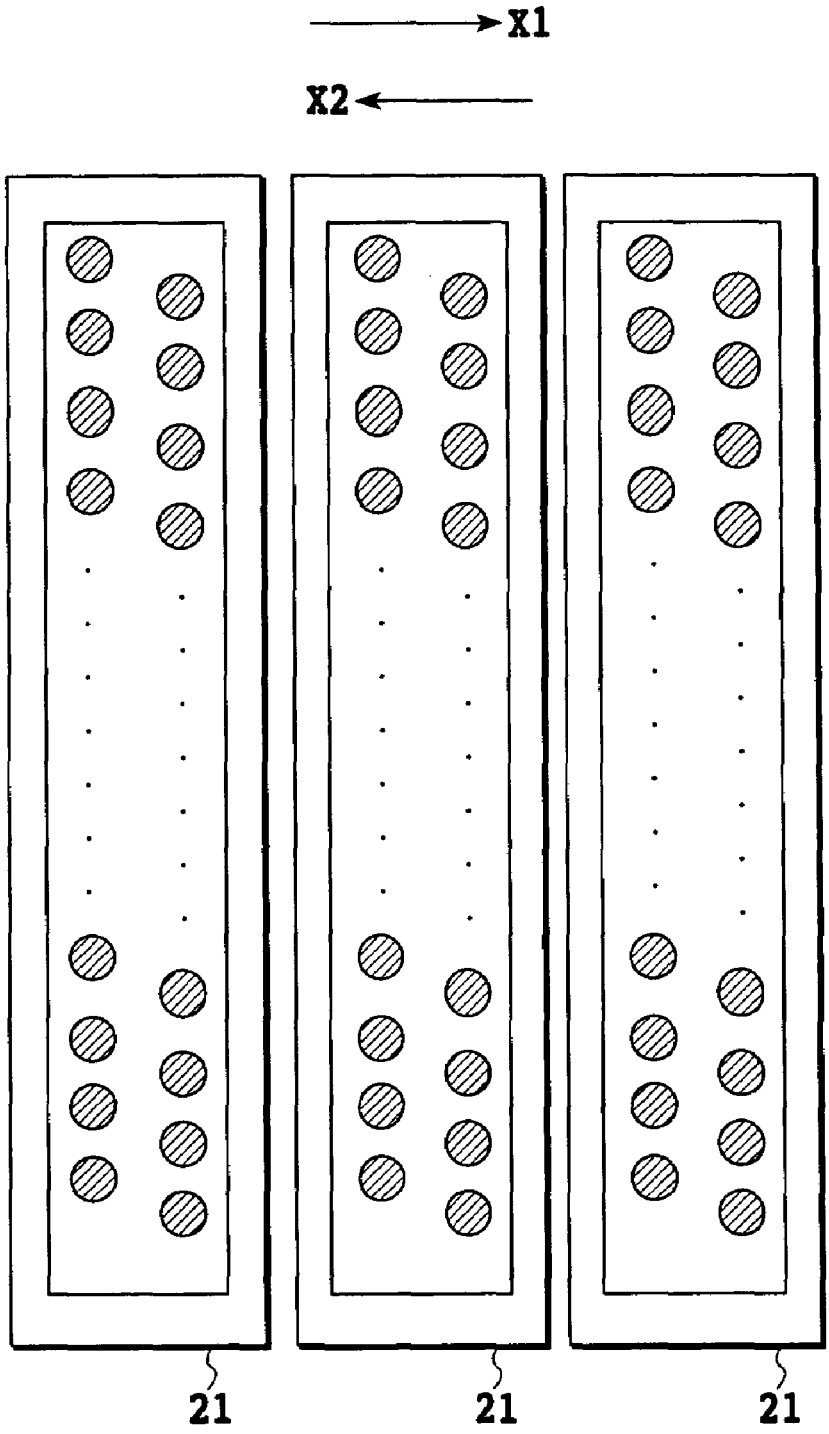
FIG. 2 is an illustration of the structure of a printing head of the inkjet printing apparatus shown in FIG. 1.

FIG. 2 illustrates a schematic structure of the printing head 21.

In FIG. 2, nozzle lines having a plurality of ink ejection ports are formed substantially perpendicular to the main scanning direction indicated by arrows X1 and X2. In this embodiment, two nozzle lines are formed in a single printing head 21. However, a single line or more than three lines may be acceptable and the ink ejection ports need not be arranged linearly. While the printing heads 21 are moving in the main scanning direction, ink is ejected from an ink ejection port to form an image corresponding to the width of the nozzle line ejecting ink. The number of printing heads 21 is not limited and may be changed as needed. For example, when a full color image is formed, three printing heads 21 ejecting cyan, magenta, and yellow inks may be employed. When a monochrome image is formed, a printing head 21 ejecting black ink may be employed. When light and dark images are formed, a plurality of printing heads 21 ejecting dark cyan, light cyan, dark magenta, light magenta, dark black, light black, dark yellow, and light yellow inks may be used. Alternatively, a printing head 21 ejecting specific color ink may be used.

The inkjet printing apparatus applicable to the present invention is not limited to a Bubble Jet (trade name) system using a heater element (heater). In the case of a continuous ejection type printing apparatus for ejecting ink drops continuously to form particles, a charge control system and diversion control system can be used. In the case of an on-demand type, which ejects ink drops as needed, a pressure control system ejecting ink drops from an orifice by mechanical vibration of a piezo vibration element is used.

Figure 3:
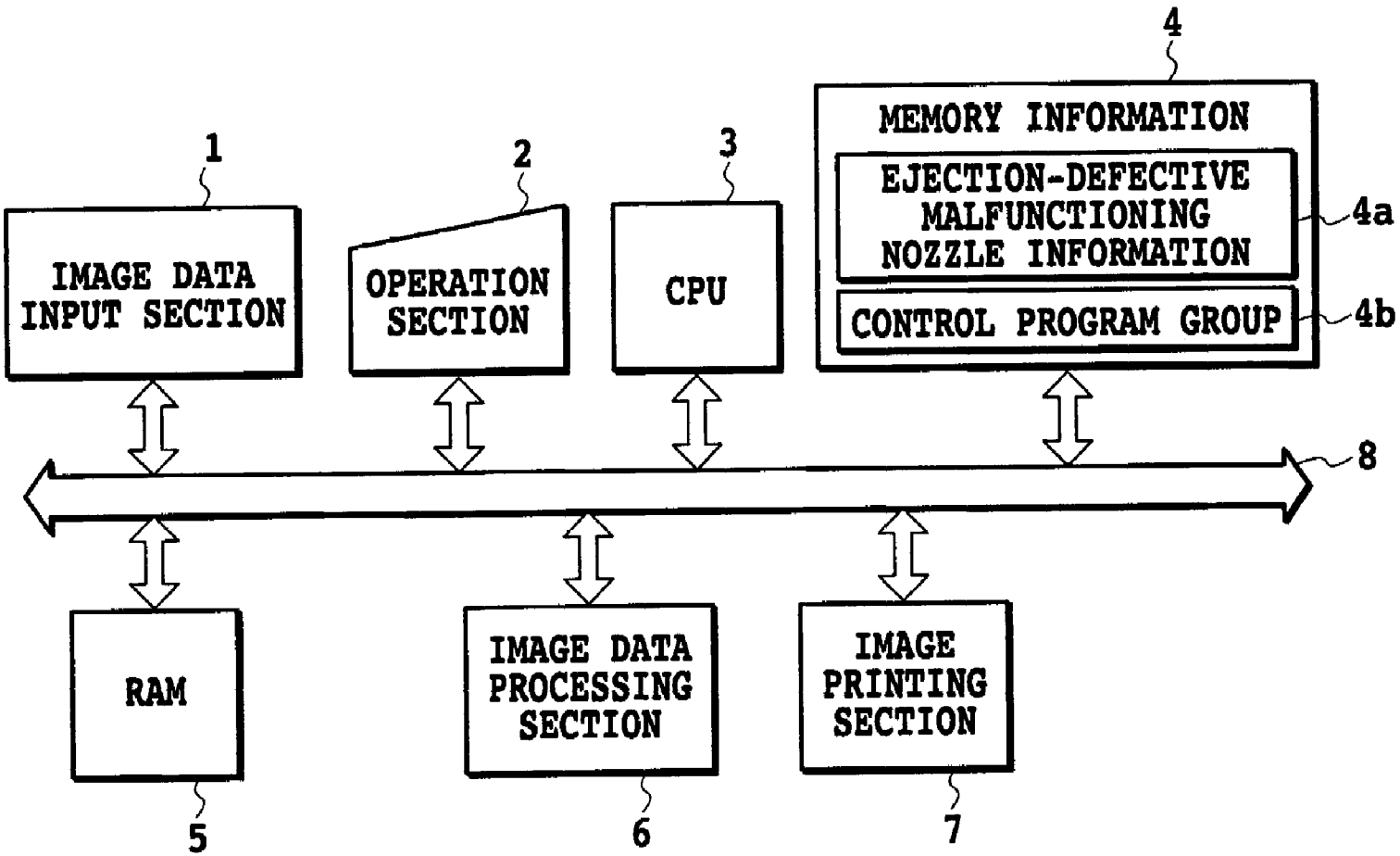
FIG. 3 is a block diagram illustrating the control system of the inkjet printing apparatus of FIG. 1.

FIG. 3 is a block diagram illustrating the construction of the control system of an inkjet-printing apparatus of the present invention.

In FIG. 3, reference numeral 1 indicates an image data input section, 2 indicates an operation section, 3 indicates a CPU for performing various processes, and 4 indicates a memory medium for storing various data. Reference numeral 4*a* indicates data for an ejection defective malfunctioning nozzle and 4*b* indicates various control programs. Reference numeral 5 indicates a RAM, 6 indicates an image data processing section, 7 indicates an image printing section for outputting an image, and 8 indicates a bus section for transmitting various data.

To describe more specifically, the image data input section 1 is a section for inputting multi-valued image data from an image input machine, such as a scanner or a digital camera, and multi-valued image data stored in a hard disk, such as a personal computer. The operation section 2 has various keys for instructing the setting of various parameters and the initiation of printing. The CPU 3 controls the entire printing apparatus in accordance with various programs stored in the memory medium 4. The memory medium 4 stores programs, such as a control program and an error correction program, based on which the printing apparatus is operated. In this embodiment, all operations are performed in accordance with the programs stored in the memory device. Examples of the memory medium 4 storing these programs include a ROM, FD, CD-ROM, HD, memory card, and magneto-optic disk. The RAM 5 is used as a work area for various programs, a temporary sheltering area for error correction, and a work area for image processing. The RAM 5 may modify the contents of various tables copied from the memory medium 4 and perform image processing with reference to the modified tables.

The image data processing section 6 quantizes input multi-valued image data for each pixel to N-valued image data and forms the ejection pattern corresponding to gradation scale "T" exhibited by each quantized pixel. More specifically, the image data processing section 6 converts input multi-valued image data into N-valued image data and thereafter forms the ejection pattern corresponding to gradation scale T. For example, when multi-valued image data represented by 8 bits (256 gradation scales) is input to the image data input section 1, the image data processing section 6 must convert the image data to be output to gradation scales 25 (24+1). In this embodiment, a multi-value error diffusion method is used for T value conversion process of the input gradation scale image data. However, the present invention is not limited to these. Any halftones processing method such as an average concentration conservation method or dither matrix method may be used. Furthermore, by repeating T value conversion a number of times corresponding to the number of all pixels based on the concentration data of an image, binary drive data of each nozzle as to whether ink is to be ejected or not per pixel can be formed.

The image printing section 7 forms a dot image on a printing medium by ejecting ink from nozzles of the printing head 21 based on the ejection pattern prepared in the image data processing section 6. The image printing section 7 may be constructed as shown in FIG. 1. The bus line 8 transmits address signals, data, control signals, and so on.

Referring now to FIGS. 4 to 9, the ejection-defective malfunction nozzle information 4*a*, a method for preparing printing data based on the information 4*a* and a practical printing method will be explained.

Figure 4:
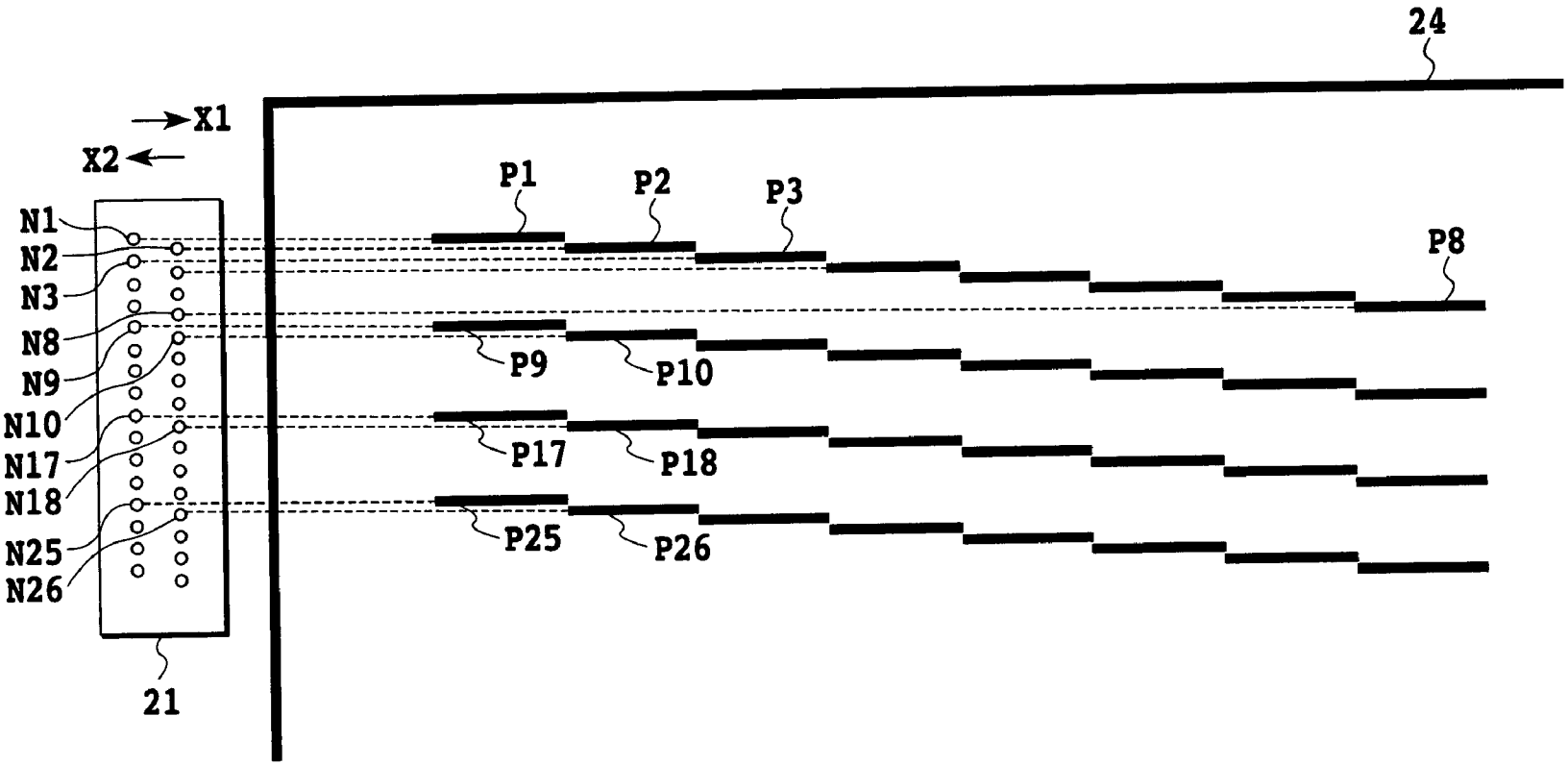
FIG. 4 is an illustration of a printing pattern for use in detecting an abnormal nozzle in an embodiment of the present invention.

First, to know the state of a nozzle of the printing head 21, nozzle information is obtained. The nozzle information includes information of whether or not an ejection-defective nozzle incapable of ejecting ink and a malfunction nozzle malfunctioning in ejecting ink (hereinafter they are referred to as an "ejection-defective malfunctioning nozzle" or "abnormal nozzle") are present among a plurality of nozzles. In the nozzle information, the position (nozzle number) of the ejection-defective malfunctioning nozzle detected is also included. To obtain such nozzle information, the image pattern (staircase pattern) shown in FIG. 4 is printed by using the apparatus shown in FIG. 1. The staircase pattern is obtained by ejecting ink continuously or discontinuously from a predetermined number of nozzles (8 nozzles in FIG. 4) and thus includes the short lines corresponding to the nozzles. Such a pattern is printed by using the required nozzles. More specifically, when the printing head 21 having a plurality of nozzles numbered as N1, N2, N3 . . . (as shown in FIG. 4) is scanned for printing, short linear patterns P1, P2, P3 . . . corresponding to nozzle numbers N1, N2, N3 . . . are printed stepwise.

Figure 5:
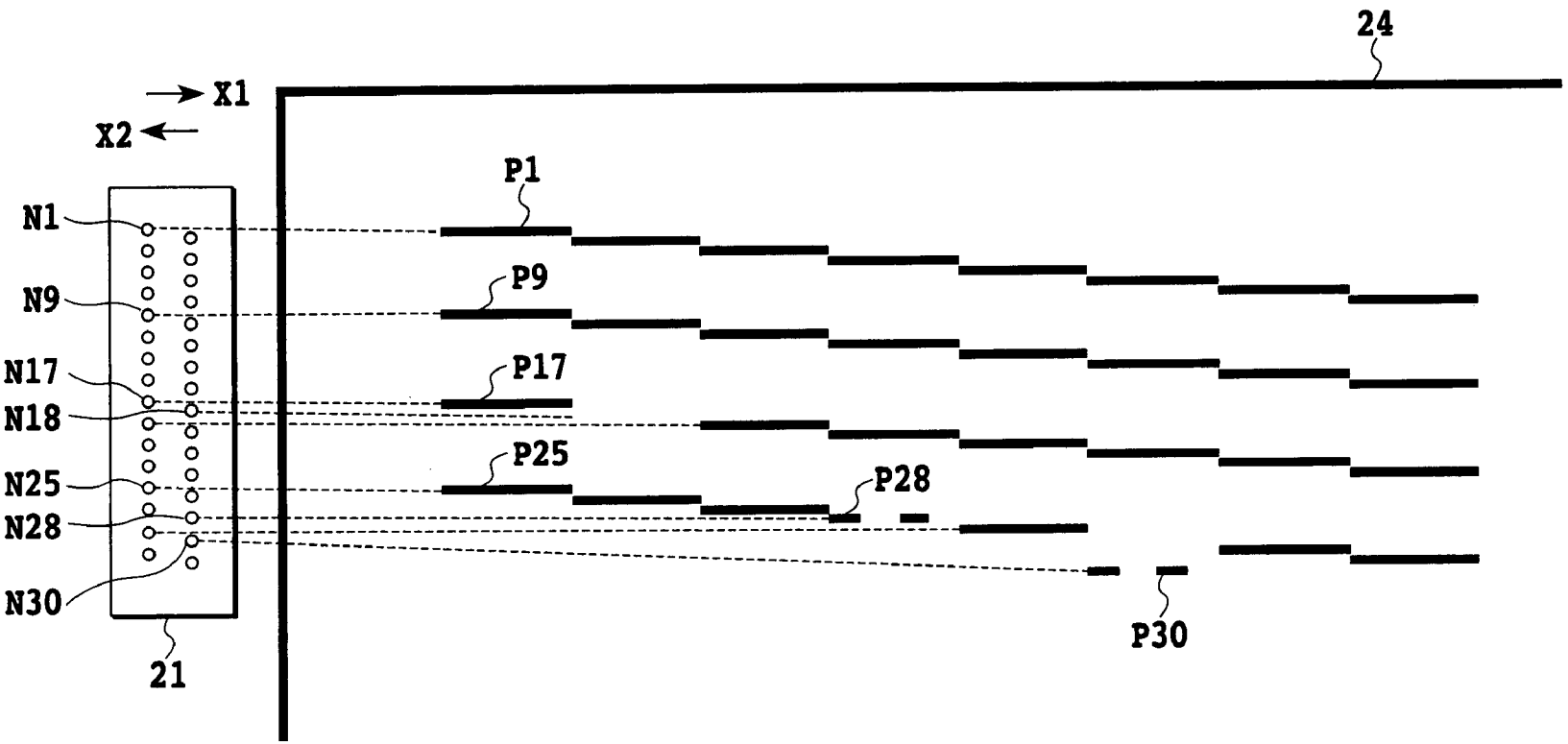
FIG. 5 is an illustration showing an abnormal nozzle compared to the printing pattern shown in FIG. 4.

When an ejection-defective nozzle incapable of ejecting ink is present, the short linear pattern corresponding to the ejection-defective nozzle is not printed. Therefore, compared to the printing result of the image pattern of FIG. 4, the ejection-defective nozzle can be identified. To be more specific, an ejection-defective nozzle can be detected by using a scanning sensor (not shown) capable of reading the image pattern (the staircase chart) of FIG. 4. On the basis of the detection results, ejection-defective nozzle information as to the ejection-defective nozzle can be made. Alternatively, an ejection-defective nozzle may be detected by visual observation instead of using a sensor. On the basis of the information as to the ejection-defective nozzle, the ejection-defective nozzle information can be made, and the ejection-defective nozzle information may be input in the printing apparatus. The ejection-defective nozzle information is prepared with respect to every printing head 21. FIG. 5 is an example of the printed staircase chart of the image pattern of FIG. 4. In this chart, since a short linear pattern P18 corresponding to nozzle N18 is not printed, nozzle N18 is identified as an ejection-defective nozzle.

When a malfunction nozzle malfunctioning in ejecting ink is present, irregularity appears in the linear pattern corresponding to the malfunction nozzle. For example, the short linear pattern corresponding to the malfunction nozzle lacks linearity. With reference to the staircase chart of the image pattern of FIG. 4, a nozzle whose short linear pattern lacks linearity and whose ink-ejection state is significantly unstable can be identified. These nozzles are malfunction nozzles malfunctioning in ejecting ink. In the staircase chart of FIG. 5, the short linear patterns P28 and P30 corresponding to nozzles N28 and N30 are abnormal, so they are determined as malfunction nozzles.

It is desirable that such a malfunction nozzle should not be used in order to obtain a good image printing. The malfunction nozzle can be eliminated by treating it in the same manner as an ejection-defective nozzle. More specifically, information (malfunction nozzle information) as to which nozzle is a malfunction nozzle may be added to the aforementioned ejection-defective nozzle information. In this embodiment, ejection-defective nozzle information and malfunction nozzle information are collectively treated as ejection-defective malfunctioning nozzle information 4*a* (see FIG. 3). Therefore, in the staircase chart of FIG. 5, nozzles N18, N28, and N30 are stored as ejection-defective malfunctioning nozzles in the ejection-defective malfunctioning nozzle information 4*a*.

Figure 6:
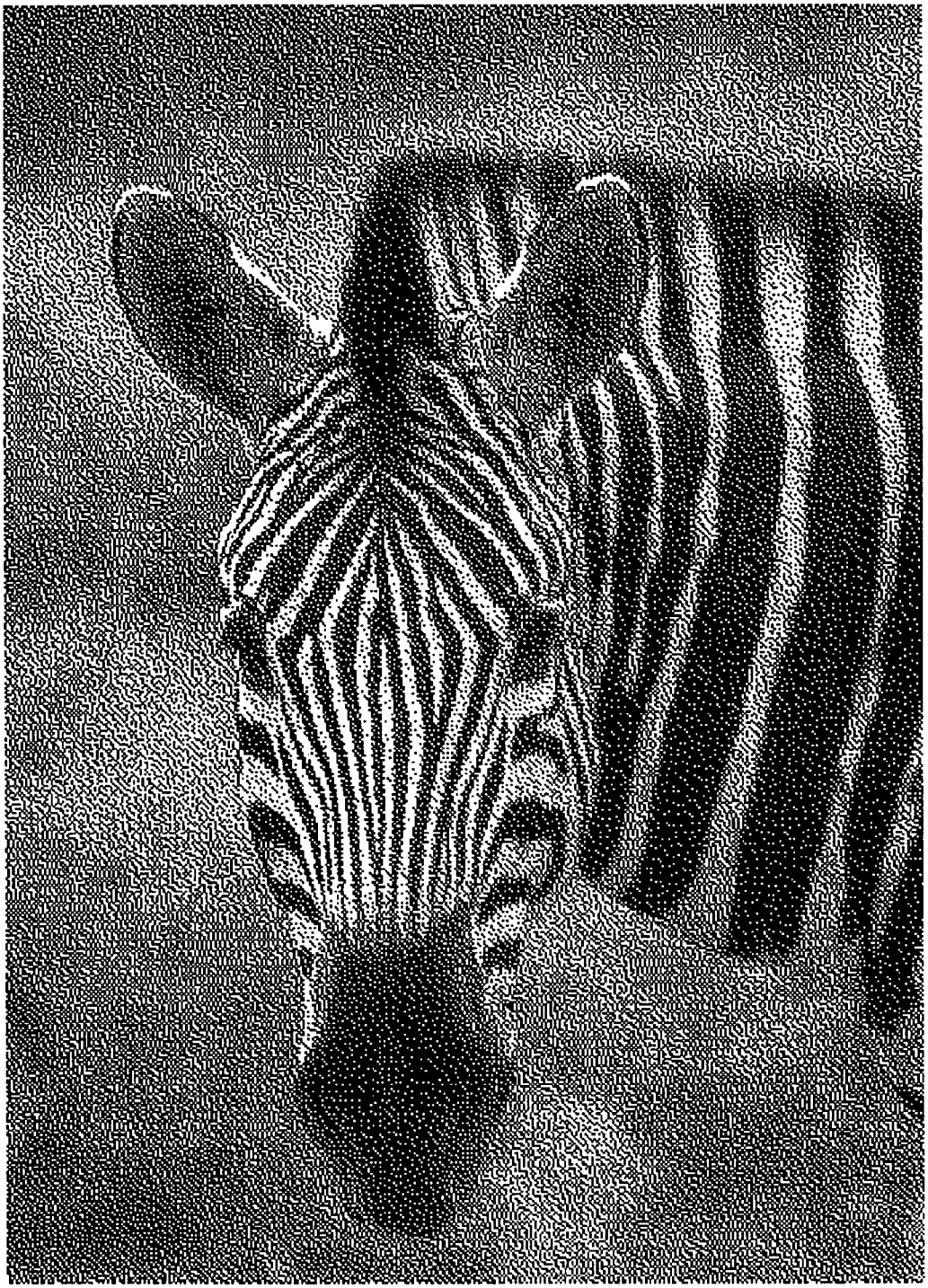
FIG. 6 is a view showing an example of a normal binary image printing.
Figure 7:
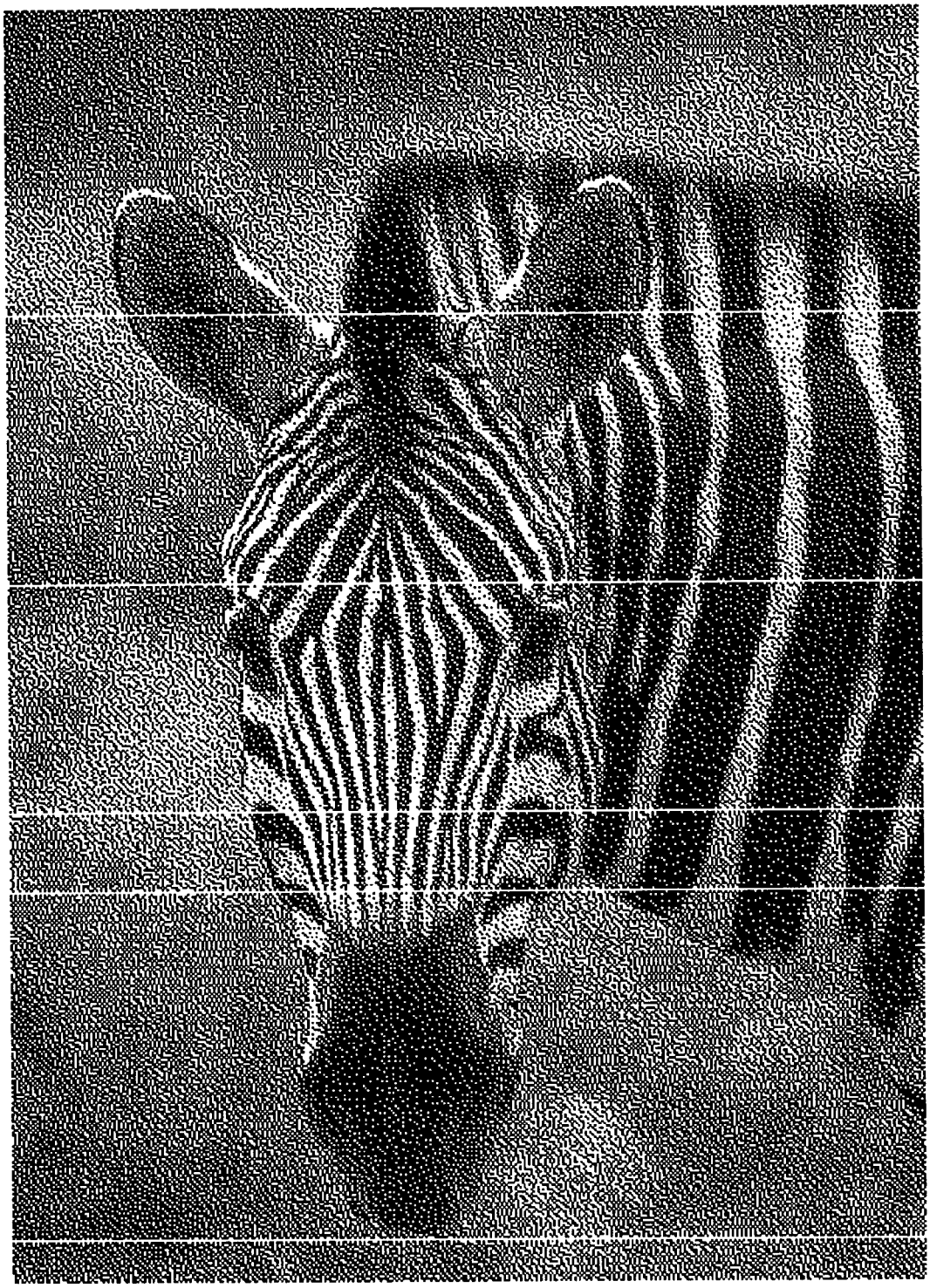
FIG. 7 is a view showing a binary image printed by a printing head having an ejection-defective or malfunctioning nozzle, the binary image being the same as that shown in FIG. 6.

The printing data for ejecting ink from the printing head 21 can be prepared by a method employed in a regular inkjet printing apparatus. In this embodiment, printing data was prepared as follows. Input image data with color data is divided so as to correspond to individual color printing heads 21. The divided gray image data for each color is converted into binary data by an error diffusion method. FIG. 6 is an enlarged partial view of an image printed by the printing head 21 ejecting black ink. If an ejection-defective nozzle is present when the image is printed, the image shown in FIG. 7 is obtained. Since ink dots are not formed at predetermined places, a white streaking appears on the printed image, significantly deteriorating the image quality.

Subsequently, a method of forming printing data based on the ejection-defective malfunctioning nozzle information 4*a* will be explained.

Figure 8:
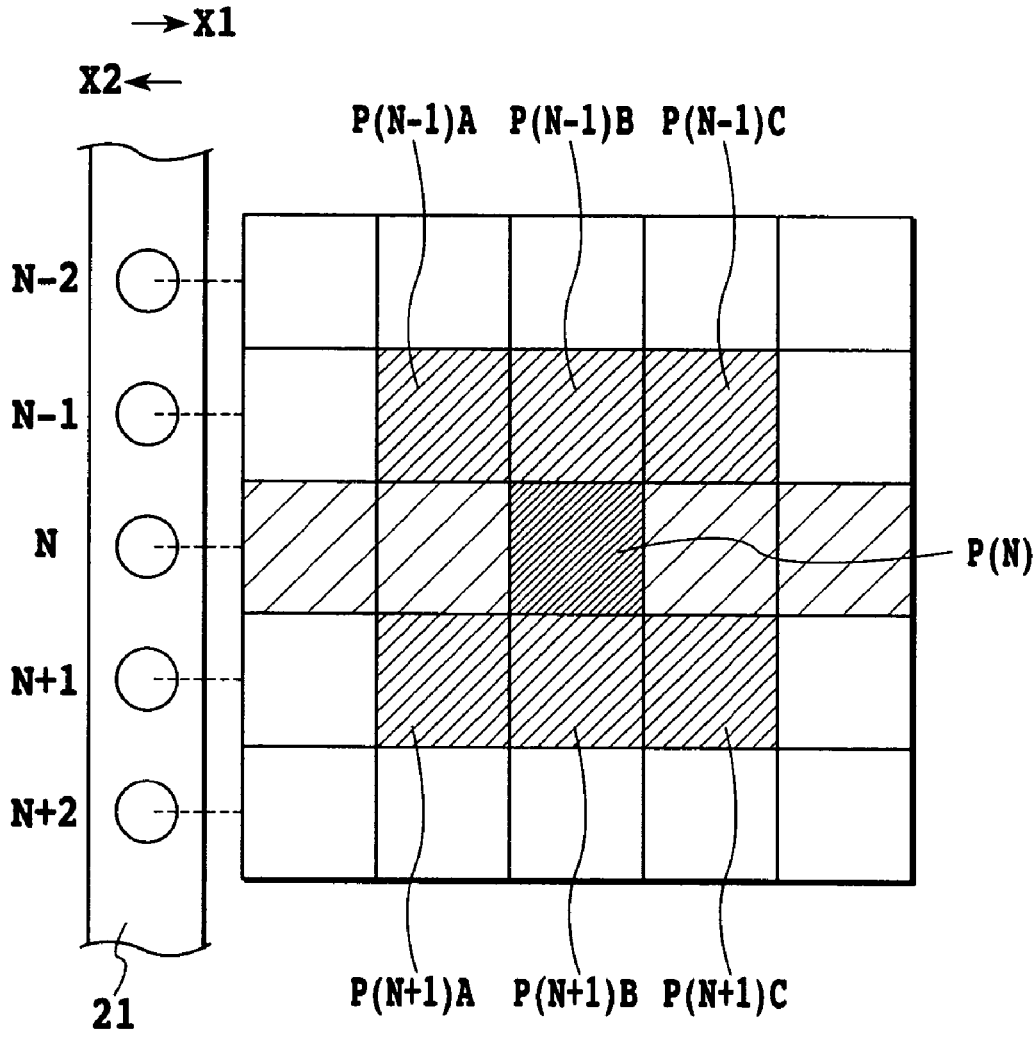
FIG. 8 is a conceptual view illustrating a method for compensating printing data to be printed by an abnormal nozzle in an embodiment of the present invention.

FIG. 8 shows a basic conceptual view of the present invention.

In FIG. 8, a pixel P (N) is one to be formed by a nozzle (N), which is determined as an ejection-defective malfunctioning nozzle. The printing data of the pixel P (N) is added to the printing data corresponding to nozzles in the neighborhood of the nozzle (N). In this embodiment, the printing data of the pixel P (N) is added to the printing data corresponding to neighboring nozzles (N−1) and (N+1) adjacent to the nozzle (N). As a result, instead of forming pixel P (N), pixels P (N−1) A, P (N−1) B, P (N−1) C, P (N+1) A, P (N+1) B, and P (N+1) Care formed. The addition of printing data may be attained by changing binary image data, which has been formed in order to correspond to ejection and non-ejection of ink. With this feature, the apparatus is constructed simply. Since data processing can be made easily, the printing speed can be increased.

Neighboring nozzles, to which the printing data corresponding to an abnormal nozzle (ejection-defective malfunctioning nozzle) is to be added, are not necessarily next to the abnormal nozzle, as shown in FIG. 8. For example, when a neighboring nozzle already has printing data to be printed, a pixel to be formed by addition of printing data is searched in the neighbor and the printing data may be added to the nozzle corresponding to the pixel so as to form the pixel. When the printing data is added to the upper or lower nozzles (N−1) and (N+1) of FIG. 8, the printing data may be added in accordance with a predetermined order of upper and lower nozzles or by checking whether the upper and lower nozzles (N−1) or (N+1) store data or not. In either case, the present invention is preferably carried out by adding the printing data corresponding to an abnormal nozzle to that of neighboring nozzles.

Furthermore, when abnormal nozzles are present continuously, the printing data to be printed by the abnormal nozzles may be added to those of the neighboring nozzles above and below the abnormal nozzles. In this case, the effect of the present invention may be confirmed. The process for adding the printing data to the neighboring nozzles can be performed by increasing the driving frequency during the printing operation time. Therefore, the present invention can be preferably carried out by simply adding the printing data to be printed by an abnormal nozzle to the neighboring nozzles, regardless of the presence or absence of the printing data in the neighboring nozzles.

Furthermore, the present invention may be preferably applied to a multi-pass printing system. In the multi-pass printing system, it is proposed that, after an abnormal nozzle is detected, the printing data to be printed by the abnormal nozzle is covered by that of another nozzle during another pass-printing time. The present invention can prevent deterioration of image quality caused by the presence of an abnormal nozzle by a simple data processing method performed in substantially the same pass time. Therefore, the present invention may be effectively used in the multi-pass printing system.

The present invention can be preferably applied to an inkjet printing apparatus using a plurality of dark and light inks per color and an inkjet printing apparatus forming large and small dots, although cost increase is accompanied more or less. Also in this case, a high quality image can be formed on a printing medium by the present invention.

Also, the present invention is more preferably applied to the inkjet printing head 21 shown in FIG. 2. The printing head 21 has a nozzle group consisting of a plurality of nozzles arranged substantially perpendicular to a main scanning direction. The adjacent nozzles (printing can be made in the same scanning operation) are arranged at an interval corresponding to that between adjacent pixels of the image to be printed. In the printing head 21, if adjacent nozzles are arranged at an interval larger than that between adjacent pixels, the present invention can be attained by a more complicated method. Therefore, the adjacent nozzles are desirably arranged substantially close to each other as shown in FIG. 2. For example, when a small-size printed matter, such as a pocket-size photograph, is obtained with high quality by the inkjet printing system, the adjacent nozzles are preferably arranged at a distance of about 300 dpi (100 μm) when the ejecting volume of each ink-droplet is about 40±10 pl. When the volume of each ink-droplet is about 10±5 pl, the adjacent nozzles are preferably arranged at a distance of about 600 dpi (40 μm). When the volume of each ink-droplet is about 5±2 pl, the adjacent nozzles are preferably arranged at a distance of about 1200 dpi (20 μm). Furthermore, when the volume of each ink-droplet is about 2±1 pl, the adjacent nozzles are preferably arranged at a distance of about 2400 dpi (10 μm).

To obtain such a nozzle group relatively easily and at low cost, the following inkjet printing system can be employed. However, the present invention is not limited to the printing system below.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows. First, one or more drive signals are applied to the electrothermal transducers to cause thermal energy corresponding to recording information. Second, the thermal energy induces sudden temperature rise that exceeds the nucleate boiling point so as to cause film boiling on heating portions of the recording head. Third, bubbles are formed in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which may be used in the present invention. This structure includes heating portions disposed on bent portions in addition to a combination of the ejection orifices, liquid passages and the electrothermal transducers disclosed in the above patents.

Moreover, the present invention can be applied to structures disclosed in Japanese Patent Application Laid-Open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can also be applied to a so-called full-line type recording head whose length equals the maximum length across a recording medium. Such a recording head may consist of a plurality of recording heads combined together, or one integrally arranged recording head.

In addition, the present invention can be applied to various serial type recording heads. For example, a recording head fixed to the main assembly of a recording apparatus, a conveniently replaceable chip type recording head which, when loaded on the main assembly of a recording apparatus, is electrically connected to the main assembly, and is supplied with ink therefrom, and/or a cartridge type recording head integrally including an ink reservoir may be used.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording.

In the present invention, the most effective embodiment with respect to each ink likely occurs when the aforementioned film boiling system is carried out.

EMBODIMENTS

The present invention will now be explained more specifically by way of embodiments.

Embodiment 1

An image was printed by using Y (yellow), M (magenta), C (cyan), and K (black) ink each containing a coloring material in accordance with the aforementioned printing method using the aforementioned inkjet printing apparatus. The inkjet printing apparatus gives a resolution of 1200 dpi and the volume of each ink drop is 4.5±0.5 pl.

The compositions of inks containing coloring materials are as follows:

| | |
|---|---|
| (Y ink composition) | |
| Glycerin | 5.0 parts by weight |
| Thiodiglycol | 5.0 parts by weight |
| Urea | 5.0 parts by weight |
| Isopropyl alcohol | 4.0 parts by weight |
| Dye C.I. direct yellow 142 | 2.0 parts by weight |
| Water | 79.0 parts by weight |
| (M ink composition) | |
| Glycerin | 5.0 parts by weight |
| Thiodiglycol | 5.0 parts by weight |
| Urea | 5.0 parts by weight |
| Isopropyl alcohol | 4.0 parts by weight |
| Dye C.I. acid red 289 | 2.5 parts by weight |
| Water | 78.5 parts by weight |
| (C ink composition) | |
| Glycerin | 5.0 parts by weight |
| Thiodiglycol | 5.0 parts by weight |
| Urea | 5.0 parts by weight |
| Isopropyl alcohol | 4.0 parts by weight |
| Dye C.I. direct blue 199 | 2.5 parts by weight |
| Water | 78.5 parts by weight |
| (K ink composition) | |
| Glycerin | 5.0 parts by weight |
| Thiodiglycol | 5.0 parts by weight |
| Urea | 5.0 parts by weight |
| Isopropyl alcohol | 4.0 parts by weight |
| Dye Food black 2 | 3.0 parts by weight |
| Water | 78.0 parts by weight |

As a printing medium, electrophotographic/inkjet printing paper (PB-PAPER: manufactured by Canon Corporation) was prepared. Printing was effected by using the aforementioned color inks and the printing medium.

Figure 9:
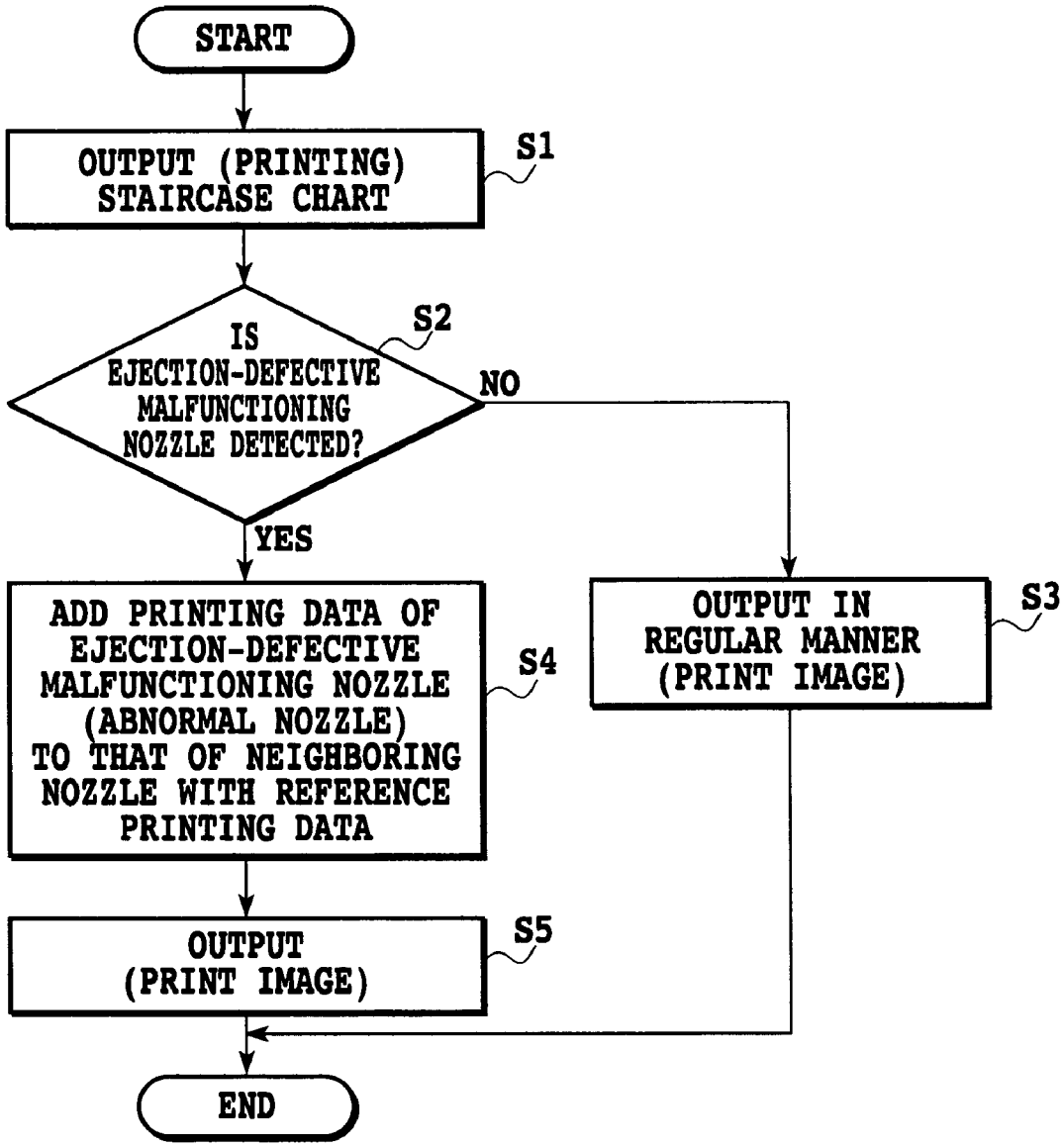
FIG. 9 is a flowchart for showing the printing operation in a first embodiment of the present invention.

FIG. 9 is a flowchart illustrating a control procedure. First, the staircase chart mentioned above is output (printed) (Step S1). From the output results, an abnormal nozzle (ejection-defective malfunctioning nozzle) is detected (Step S2). When no abnormal nozzle is detected, general image output procedure (image printing) is carried out (Step S3). On the other hand, if an abnormal nozzle is detected, printing data to be printed by the abnormal nozzle is added to the printing data of a neighboring nozzle with reference to the printing data, as described later (Step S4), and thereafter, image output (image printing) procedure is carried out (Step S5).

Figure 10A:
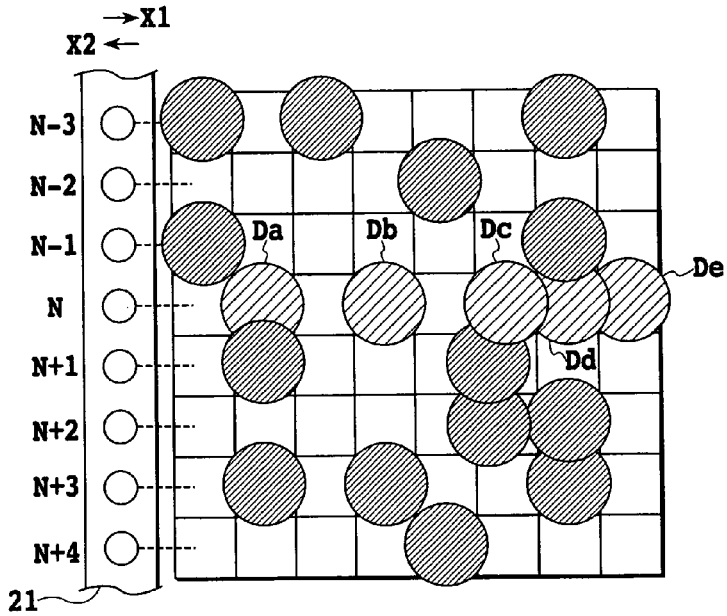
FIG. 10A is an illustration of printing data before a compensation process in a first embodiment of the present invention.
Figure 10B:
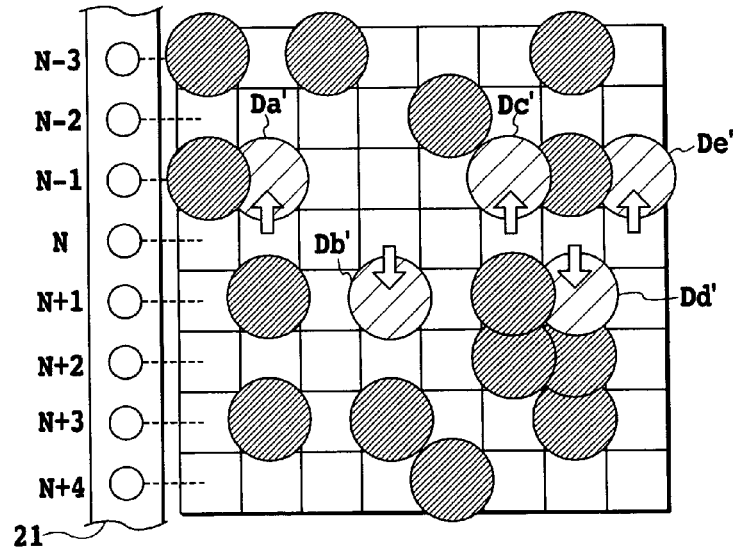
FIG. 10B is an illustration of printing data after the compensation process in the first embodiment of the present invention.
Figure 10B:
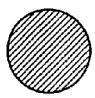
Figure 10B:
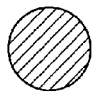
Figure 10B:
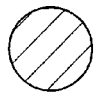

FIGS. 10A and 10B illustrate the specific process of Step S4 (process for compensating printing data). These figures show the relationship between a part of a plurality of nozzles (e.g., 512 nozzles) of the printing head 21 and the printing data to be printed by the nozzle. The printing data is a binary value driving signal for ejecting ink or not and, more specifically, correspond to on or off signal for ejecting ink out of a nozzle or not. In the matrix at the right-hand side in each of FIGS. 10A and 10B, printing resolutions and ink dot formation positions on a printing medium are shown. In this embodiment, assuming that an N-th nozzle (N) is detected as an abnormal nozzle (ejection-defective malfunctioning nozzle), Da to De of FIG. 10A are printing data to be printed by the abnormal nozzle (N) and correspond to on-signals (ejection signals) for ejecting ink. Therefore, when the printing data Da to De are printed as they are without compensating the printing data Da to De to be printed by the abnormal nozzle (N), an image defect (streaking), such as a white streaking, appears on the site of the printed image corresponding to the nozzle (N).

In this embodiment, as shown in FIG. 10B, the printing data Da to De to be printed by the abnormal nozzle (N) are added to the printing data to be printed by the adjacent nozzles (N−1) and (N+1). In other words, the printing data Da to De of the nozzle (N) are alternately distributed to the printing data to be printed by the nozzles (N−1) and (N+1) depending upon the scanning position of the printing head 21. The printing data Da' to De' represent the printing data Da to De which have been added to those of the nozzles (N−1) and (N+1). The printing data Da (ejection signal) is added to that of the adjacent nozzle (N−1) arranged above the nozzle N and the printing data Db (ejection data) is added to that of the adjacent nozzle (N+1) arranged below. By repeating this procedure, the printing data Dc to De are sequentially added to the printing data to be printed by the nozzles (N−1) and (N+1).

The printing apparatus prints an image by performing the same compensation process throughout the entire image data. As a result, a high quality image is obtained while a white streaking is prevented from appearing on the printed image.

Comparative Embodiment 1

In this comparative embodiment, printing was performed without performing the compensation process of the printing data as is in Embodiment 1. As a result, a white streaking appeared on the printed image. Thus, the quality of the obtained printed image was low.

Embodiment 2

Figure 11A:
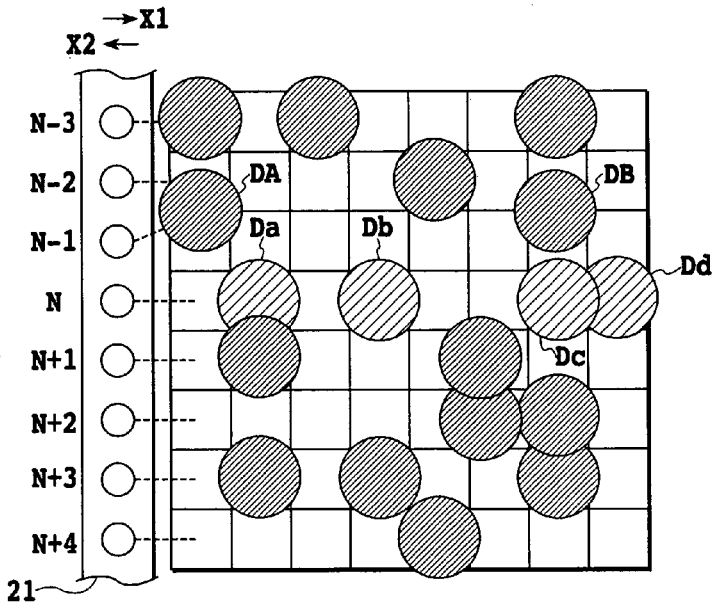
FIG. 11A is an illustration of printing data before a compensation process in a second embodiment of the present invention.
Figure 11B:
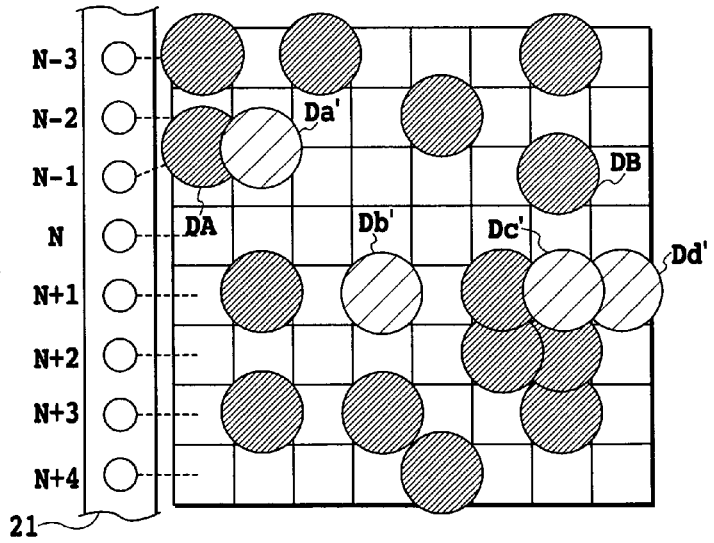
FIG. 11B is an illustration of printing data after the compensation process in the second embodiment of the present invention.
Figure 11B:
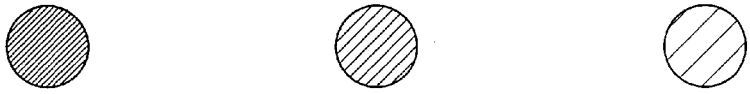

In this embodiment of the present invention, the process for compensating printing data is performed as shown in FIGS. 11A and 11B.

This embodiment deals with the case where malfunction nozzles (hereinafter, referred to as a "neighboring malfunction nozzle") are included in the neighboring nozzles arranged in the vicinity of an abnormal nozzle (ejection-defective malfunctioning nozzle). To explain more specifically, a larger portion of the printing data to be printed by an abnormal nozzle is added to the printing data to be printed by a normal neighboring nozzle than to that of the neighboring malfunction nozzle. The neighboring malfunction nozzle herein is, for example, a malfunction nozzle which shoots ink droplets onto a position slightly deviated from a right target.

In FIG. 11A, it is assumed that an N-th nozzle (N) is identified as an abnormal nozzle and the neighboring nozzle (N−1) is determined as a malfunction nozzle. Also in FIG. 11A, Da to Dd are printing data to be printed by an abnormal nozzle (N), and DA and DB are printing data to be printed by the neighboring malfunction nozzle (N−1). These printing data correspond to an on signal (ejection signal) for ejecting ink. The ink landing position on a printing medium by the neighboring malfunction nozzle (N−1) of this embodiment is slightly deviated from a right position. Therefore, the ink dot formation positions corresponding to printing data DA and DB shift slightly upward from the right position as shown in FIG. 11A.

In this embodiment, as shown in FIG. 11B, the data Da to De to be printed by the abnormal nozzle (N) are added to those of the neighboring nozzles (N−1) and (N+1). More specifically, the printing data Da to De to be printed by the abnormal nozzle (N) are added in a larger amount to the normal neighboring nozzle (N+1) than to the neighboring malfunction nozzle (N−1). Printing data Da' represents the printing data Da which has been added to that of the neighboring malfunction nozzle (N−1). Printing data Db' to Dd' represent the printing data Db to Dd which have been added to that of the normal neighboring nozzle (N+1). Likewise, by adding printing data to be printed by the abnormal nozzle (N) to printing data to be printed by the neighboring nozzles, printing data is formed in which the printing data of the abnormal nozzle is compensated.

An image was printed based on the printing data obtained through the compensation process in the same manner as in Embodiment 1. As a result, a good image having excellent gradation and less deterioration due to white streaking was obtained similarly to Embodiment 1. Compared to the case where the printing data to be printed by an abnormal nozzle is equally divided and added to those of upper and lower nozzles, the quality of the image obtained in this embodiment can be improved.

Embodiment 3

Figure 12A:
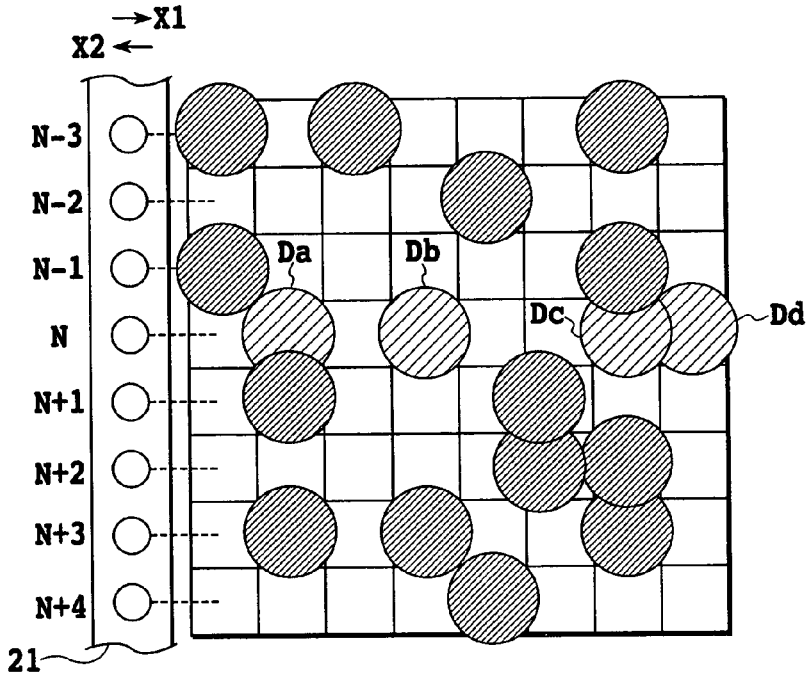
FIG. 12A is an illustration of printing data before a compensation process in a third embodiment of the present invention.
Figure 12B:
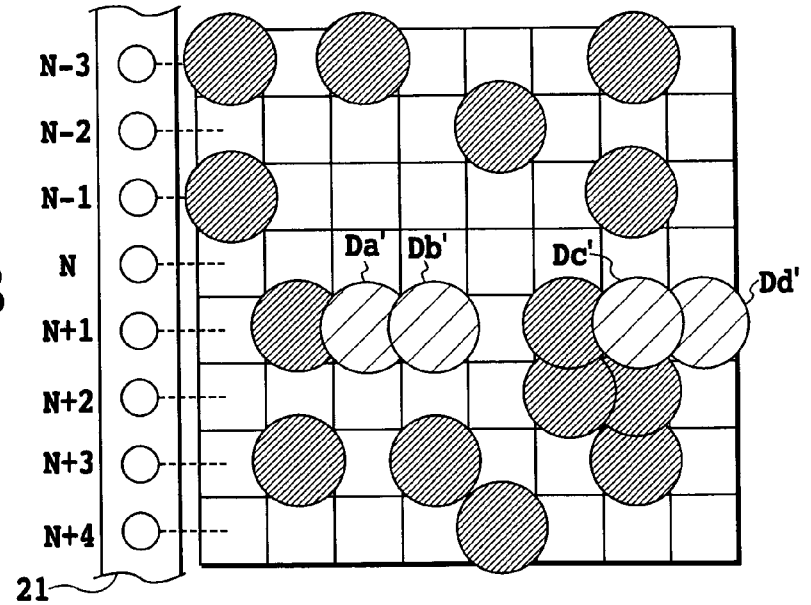
FIG. 12B is an illustration of printing data after the compensation process in the third embodiment of the present invention.
Figure 12B:
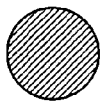
Figure 12B:
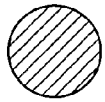
Figure 12B:
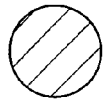

In this embodiment, the process of compensating printing data is performed as shown in FIGS. 12A and 12B. To be more specific, the printing data to be printed by an abnormal nozzle is added to that of a specific neighboring nozzle of a plurality of neighboring nozzles around the abnormal nozzle (ejection-defective malfunctioning nozzle).

In FIG. 12A, it is assumed that an N-th nozzle (N) is identified as an abnormal nozzle. Also in FIG. 12A, Da to Dd are printing data to be printed by an abnormal nozzle (N) and correspond to an on signal (ejection signal) for ejecting ink. In this embodiment, as shown in FIG. 12B, the printing data Da to Dd to be printed by the abnormal nozzle (N) are added to the printing data of the neighboring nozzle (N+1) arranged one nozzle lower. The printing data Da' to Dd' represent the printing data Da to Dd which have been added to that to be printed by the neighboring nozzle (N+1). Likewise, by adding the printing data to be printed by the abnormal nozzle (N) to that of a neighboring nozzle, printing data is formed in which the printing data of the abnormal nozzle is compensated.

An image was printed based on the printing data obtained through the compensation process in the same manner as in Embodiment 1. As a result, a good image having excellent gradation and less deterioration due to white streaking was obtained similarly to Embodiment 1. Compared to the case where the printing data to be printed by the abnormal nozzle is equally divided and added to upper and lower nozzles, the image obtained in this embodiment improved in quality since a touch of a line drawing can be expressed more finely.

Embodiment 4

Figure 13A:
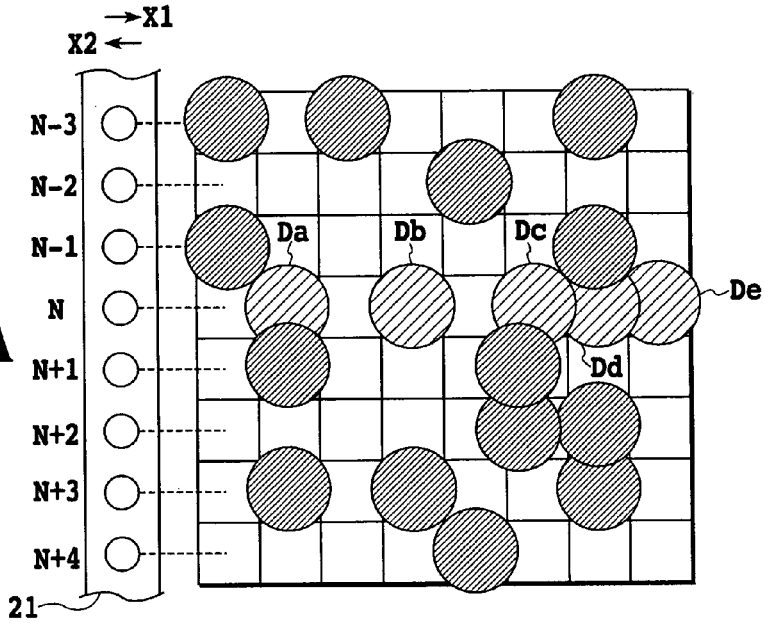
FIG. 13A is an illustration of printing data before a compensation process in a fourth embodiment of the present invention.
Figure 13B:
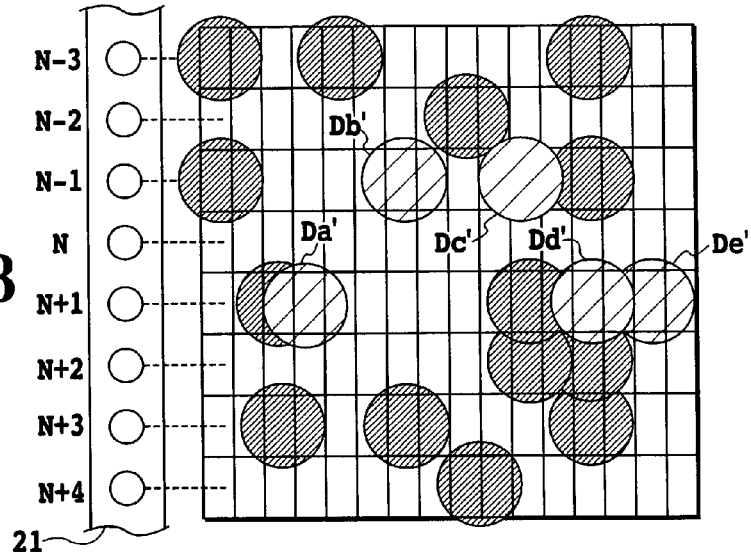
FIG. 13B is an illustration of printing data after the compensation process in the fourth embodiment of the present invention.
Figure 13B:
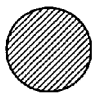
Figure 13B:
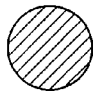
Figure 13B:
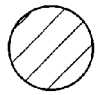

In this embodiment, the process of compensating printing data is performed as shown in FIGS. 13A and 13B. To be more specific, the data density (printing resolution) of the printing data after the compensation process is increased from that of the printing data before the compensation process.

In FIG. 13A, it is assumed that an N-th nozzle (N) is identified as an abnormal nozzle (ejection-defective malfunctioning nozzle). In FIG. 13A, Da to De are the printing data to be printed by an abnormal nozzle (N) and correspond to an on signal (ejection signal) for ejecting ink. In this embodiment, as shown in FIG. 13B, the printing data Da to De to be printed by the abnormal nozzle (N) are added to that to be printed by the neighboring nozzles (N−1) and (N+1). In this way, the printing data Da to De are compensated. The printing data Da' to De' represent the printing data Da to De which have been added to those to be printed by the neighboring nozzles (N−1) and (N+1). However, the data density of the printing data of FIG. 13B after the compensation process is twice as high as that of FIG. 13A. In addition, it has been designed that the original printing data to be printed by neighboring nozzles (N−1) and (N+1) should not be overlapped with the printing data Da to De to be compensated by the neighboring nozzles (N−1) and (N+1).

During the printing operation, the driving frequency for ejecting ink drops out of the printing head 21, that is, the number of ejections per unit time, is set twice as high as the normal frequency. The timing of ink ejection performed based on the original printing data of (N−1) and (N+1) is shifted from that performed based on the printing data Da' to De' to avoid overlapping of them. Accordingly, the printing data can be simply added in the same manner as in Embodiment 1.

An image was printed based on the compensated printing data in the same manner as in Embodiment 1. As a result, a good image having excellent gradation and less deterioration due to white streaking was obtained similarly to Embodiment 1. In this embodiment, the printing resolution of the printing head 21 can be improved when printing data corresponding to an abnormal nozzle is added to the printing data corresponding to the neighboring nozzle.

Embodiment 5

In Embodiments 1 to 4, an ink drop of 4.5±0.5 pl was ejected out of the nozzle by using the printing head 21 having nozzles arranged at the intervals (resolution) of 1200 dpi. As a result, the quality of the printed image was also improved. When a high-quality pocket photograph is printed as a printing image, sufficient effect was obtained. Furthermore, when an A4 size printed medium was prepared, more effective results were obtained if it was observed at a distance.

The present invention is effective when the distance between an ejection-defective malfunctioning nozzle and a neighboring nozzle is small. Furthermore, it is effective if the distance is smaller than the ink dot diameter shooting on a printing medium.

Comparative Embodiment 2

Furthermore, in the case where an ink drop of 4.5±0.5 pl was ejected out of the nozzle by using the printing head 21 having nozzles arranged at the intervals (resolution) of 600 dpi, the quality of printed image was improved. However, when a high quality pocket photograph was printed, it is difficult to say that the effect is sufficient.

Other Embodiments

It may be possible to divide the printing data corresponding to an abnormal nozzle into a plurality of data items and add to the printing data corresponding to a plurality of neighboring nozzles so as to distribute them. In this case, the distribution ratio of the printing data may be changed depending upon the type of image to be printed.

The manner (compensation mode) of adding the printing data corresponding to an abnormal nozzle to the printing data corresponding to a plurality of neighboring nozzles may be varied depending upon the type of printing medium.

In the case where an N-th nozzle along a line consisting of a plurality of nozzles is abnormal, the printing data corresponding to the abnormal nozzle can be added to at least one of the printing data corresponding to an (N−M)-th nozzle and (N+M)-th nozzle in the neighborhood of the N-th abnormal nozzle (N and M are positive integers). In this case, similar to the embodiments mentioned above, the distribution ratio of the printing data corresponding to the abnormal nozzle to be added to those corresponding to a plurality of neighboring nozzles may be determined based on the state of the neighboring nozzles. The states of the neighboring nozzles can be obtained from the ink-droplet shooting information, which is information on ink droplets ejected out of the neighboring nozzle and landed on a printing medium. The ink-droplet shooting information may include at least one of data about the position of the ink dot landed on the printing medium and the diameters of ink droplets formed on the printing medium.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An inkjet printing method using a printing head having a plurality of nozzles capable of ejecting ink for printing an image by ejecting ink based on printing data which instructs ejection or non-ejection of ink, the plurality of nozzles being aligned next to each other along a predetermined direction, the printing head being driven based on the printing data to eject ink, wherein the printing data corresponding to an abnormal nozzle malfunctioning in ink-ejection is added to the printing data corresponding to a neighboring nozzle of the abnormal nozzle, when an N-th nozzle of the plurality of nozzles is an abnormal nozzle, a neighboring printing area neighboring a printing area to be printed by the N-th abnormal nozzle is printed by using an (N−M)-th neighboring nozzle and an (N+M)-th neighboring nozzle (where N and M are positive integers) arranged in the neighborhood of the N-th abnormal nozzle based on the printing data corresponding to the N-th abnormal nozzle, and when the printing data corresponding to the N-th abnormal nozzle is added to that corresponding to the (N−M)-th neighboring nozzle and the (N+M)-th neighboring nozzle, a driving frequency for ejecting ink from the (N−M)-th neighboring nozzle and the (N+M)-th neighboring nozzle is increased by 2 times, the driving frequency being a frequency for driving the printing head to eject ink in performing the printing and being defined by a number of times the plurality of nozzles in the printing head are drivable during a predetermined period, timings of ink ejection performed based on original printing data corresponding to the (N−M)-th neighboring nozzle and the (N+M)-th neighboring nozzle being shifted from timings of ink ejection performed based on the printing data added to the printing data corresponding to the (N-M)-th neighboring nozzle and the (N+M)-th neighboring nozzle.

2. An inkjet printing apparatus using a printing head having a plurality of nozzles capable of ejecting ink for printing an image by ejecting ink based on printing data which instructs ejection or non-ejection of ink, the plurality of nozzles being aligned next to each other along a predetermined direction, the printing head being driven based on the printing data to eject ink, comprising:

compensation means for adding the printing data corresponding to an abnormal nozzle malfunctioning in ink-ejection to the printing data corresponding to a neighboring nozzle of the abnormal nozzle, wherein when an N-th nozzle of the plurality of nozzles is an abnormal nozzle, a neighboring printing area neighboring a printing area to be printed by the N-th abnormal nozzle is printed by using an (N−M)-th neighboring nozzle and an (N+M)-th neighboring nozzle (where N and M are positive integers) arranged in the neighborhood of the N-th abnormal nozzle based on the printing data corresponding to the N-th abnormal nozzle; and means for, when the printing data corresponding to the N-th abnormal nozzle is added to that corresponding to the (N−M)-th neighboring nozzle and the (N+M)-th neighboring nozzle, increasing a driving frequency for ejecting ink from the (N−M)-th neighboring nozzle and the (N+M)-th neighboring nozzle by 2 times, the driving frequency being a frequency for driving the printing head to eject ink in performing the printing and being defined by the number of times the plurality of nozzles in the printing head are drivable during a predetermined period, timings of ink ejection performed based on original printing data corresponding to the (N−M)-th neighboring nozzle and the (N+M)-th neighboring nozzle being shifted from timings of ink ejection performed based on the printing data added to the printing data corresponding to the (N−M)-th neighboring nozzle and the (N+M)-th neighboring nozzle.

* * * * *